US007794208B2

(12) United States Patent
Suzuki et al.

(10) Patent No.: US 7,794,208 B2
(45) Date of Patent: Sep. 14, 2010

(54) STEAM TURBINE ROTOR, INVERTED FIR-TREE TURBINE BLADE, LOW PRESSURE STEAM TURBINE WITH THOSE ROTORS AND BLADES, AND STEAM TURBINE POWER PLANT WITH THOSE TURBINES

(75) Inventors: Fumiyuki Suzuki, Hitachi (JP); Kunio Asai, Hitachi (JP); Takeshi Kudo, Hitachi (JP); Tateki Nakamura, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 965 days.

(21) Appl. No.: 11/529,231

(22) Filed: Sep. 29, 2006

(65) Prior Publication Data

US 2007/0077146 A1 Apr. 5, 2007

(30) Foreign Application Priority Data

Sep. 30, 2005 (JP) ..... 2005-285734

(51) Int. Cl.
*F01D 5/30* (2006.01)

(52) U.S. Cl. ..... 416/219 R; 416/248

(58) Field of Classification Search ..... 416/219 R, 416/220 R, 221, 248, 215–218
See application file for complete search history.

(56) References Cited

U.S. PATENT DOCUMENTS 4,021,138 A * 5/1977 Scalzo et al. ..... 416/220 R
4,321,012 A * 3/1982 Tan et al. ..... 416/217
5,110,262 A * 5/1992 Evans ..... 416/219 R
5,147,180 A 9/1992 Johnson
5,152,669 A 10/1992 Heinig et al.
5,480,285 A * 1/1996 Patel et al. ..... 416/248
5,984,637 A * 11/1999 Matsuo ..... 416/220 R
6,065,938 A * 5/2000 Bartsch ..... 416/219 R
6,224,334 B1 5/2001 Siga et al.
6,652,237 B2 11/2003 Yehle et al.
6,726,452 B2 4/2004 Strassberger et al.

FOREIGN PATENT DOCUMENTS

CN 1057700 A 1/1992

(Continued)

OTHER PUBLICATIONS

Abstract and English translation of JP 2000-161,006, Jun. 2000.*

(Continued)

*Primary Examiner*—Christopher Verdier
(74) *Attorney, Agent, or Firm*—Brundidge & Stanger, P.C.

(57) ABSTRACT

In a turbine rotor, a rotor radial-direction hook length (Hri) of an i-th rotor hook counting from the outermost circumference of the rotor and a blade radial-direction hook length (Hbi) of an i-th blade hook counting from the outermost circumference of the blade are set to satisfy the relationship of (Hri>Hbi). In the turbine blade, a rotor circumference-direction neck width (Wri) of an i-th rotor neck counting from the outermost circumference of the rotor and a blade circumference-direction neck width (Wbi) of an i-th blade neck counting from the innermost circumference of the blade are set to satisfy the relationship of (Wri>Wbi).

10 Claims, 7 Drawing Sheets

FOREIGN PATENT DOCUMENTS

| | | | |
|---|---|---|---|
| CN | 1398322 | A | 2/2003 |
| CN | 1412418 | A | 4/2003 |
| JP | 55-84804 | | 6/1980 |
| JP | 60-065204 | | 4/1985 |
| JP | 63-306208 | | 12/1988 |
| JP | 5-086805 | | 4/1993 |
| JP | 6-108801 | | 4/1994 |
| JP | 11-324605 | | 11/1999 |
| JP | 2000-161006 | | 6/2000 |
| JP | 2001-329801 | | 11/2001 |
| JP | 2002-106302 | | 4/2002 |

OTHER PUBLICATIONS

Abstract and English translation of JP 60-065,204, Apr. 1985.*
Abstract and English translation of JP 11-324,605, Nov. 1999.*
Office Action in Japanese Patent Application No. 2005-285734 mailed Mar. 30, 2010 (with English translation).

* cited by examiner

STEAM TURBINE ROTOR, INVERTED FIR-TREE TURBINE BLADE, LOW PRESSURE STEAM TURBINE WITH THOSE ROTORS AND BLADES, AND STEAM TURBINE POWER PLANT WITH THOSE TURBINES

BACKGROUND OF THE INVENTION

1. Field of the Invention

The present invention relates to a novel steam turbine rotor having an attachment structure with respect to an inverted fir-tree blade root which is inserted in the axial direction, and to a novel inverted fir-tree turbine blade. The present invention also relates to a low-pressure steam turbine with those rotors and blades, and to a steam turbine power plant with those turbines.

2. Description of the Related Art

From the viewpoint of realizing higher capacity and higher efficiency of a steam turbine, one of the most important themes is to obtain a longer blade in the last stage of a low-pressure steam turbine. To be adapted for a centrifugal force increased with the longer blade in the last stage of the low-pressure steam turbine, design has been generally conducted aiming to increase the material strength. However, a rotor material, in particular, has higher sensitivity to stress corrosion cracking (SCC) with an increase of the material strength, and the material strength of the rotor cannot be so increased as that of a blade material. Accordingly, the longer blade in the last stage tends to increase the difference in material strength between the blade material and the rotor material which are practically usable, and to reduce a margin for the allowable stress in the rotor. That tendency gives rise to a technical problem in point of how to take stress balance between the blade and the rotor.

The related art for a turbine blade in consideration of the material difference between the blade and the rotor is disclosed in, e.g., Patent Document 1 (JP,A 60-65204). Patent Document 1 discloses a structure in which, taking into account bending of a blade hook and a rotor hook in the direction of a contact surface, the thickness of each hook of the blade and the rotor is selected in reverse proportion to the longitudinal elastic modulus of the material, thereby reducing unbalance contact and avoiding concentration of stresses.

Also, Patent Document 2 (JP,A 5-86805) discloses an inverted fir-tree turbine blade having a neck structure in which the upper radius is larger than the under radius in a blade neck at the outermost circumference. Patent Document 3 (JP,A 6-108801) and Patent Document 4 (JP,A 63-306208) disclose inverted fir-tree turbine blades having particular hook and neck structures.

SUMMARY OF THE INVENTION

As mentioned above, with an increase of the centrifugal force resulting from the longer blade of the last stage, there is a tendency to increase the difference in material strength between the blade material and the rotor material which are practically usable, and to reduce a margin for the allowable stress in the practically usable rotor. Further, in the turbine rotor having an inverted fir-tree blade root and an attachment or fitting structure, there are many evaluation items, such as shear stress, tensile stress, and peak stress, to be taken into consideration from the viewpoint of strength design. If the rotor should be damaged, the resulting influence is severer than damage of the blade.

Accordingly, it is a very important problem to select a proper shape while achieving balance among those stresses, and to reduce stress in the turbine rotor corresponding to a material strength ratio between the blade material and the rotor material.

The known technique disclosed in Patent Document 1 cannot be applied to the case where the blade and the rotor are both made of steel and a difference in the longitudinal elastic modulus is hardly present between them. Patent Documents 2-4 disclose no particular structures regarding respective lengths of the hook and the neck.

An object of the present invention is to, in a turbine rotor in which a rotor material has lower tensile strength than a blade material and the difference in tensile strength between both the materials is large, properly distribute a strength margin on the blade side to a strength margin on the rotor side with the aim of reducing shear stress in a rotor hook, increasing stiffness of the rotor hook, and reducing peak stress in a rotor neck, to thereby provide a steam turbine rotor and an inverted fir-tree turbine blade in which stress balance is made more appropriate depending on a material strength ratio of the blade material to the rotor material. Another object of the present invention is to provide a low-pressure steam turbine and a high-, intermediate- and low-pressure integral steam turbine which include those rotors and blades, as well as a steam turbine power plant with those turbines.

To achieve the above objects, the present invention provides a turbine rotor and a turbine blade in which, when the material strength of a rotor material is lower than that of a blade material and the difference in material strength between the rotor and the blade is large, stress balance is made more appropriate depending on a material strength ratio between the blade material and the rotor material. In the turbine rotor, a rotor radial-direction hook length (Hri) of an i-th rotor hook counting from the outermost circumference of the rotor and a blade radial-direction hook length (Hbi) of an i-th blade hook counting from the outermost circumference of the blade are set to satisfy the relationship of (Hri>Hbi) (i=1 to n−1). In the turbine blade, a rotor circumference-direction neck width (Wri) of an i-th rotor neck counting from the outermost circumference of the rotor and a blade circumference-direction neck width (Wbi) of an i-th blade neck counting from the innermost circumference of the blade are set to satisfy the relationship of (Wri>Wbi) (i=1 to n).

In the present invention, preferably, a rotor radial-direction hook length (Hrn) of the rotor hook at the innermost circumference of the rotor is larger than a rotor radial-direction hook length (Hrj) of a j-th intermediate rotor hook counting from the outermost circumference of the rotor (Hrn>Hrj) (j=2 to n−1). Also, a tensile strength ratio $\alpha$ between a blade material and a rotor material (i.e., blade material tensile strength/rotor material tensile strength) and a radial-direction hook length ratio $\beta$ (=Hri/Hbi) between the i-th rotor hook and the i-th blade hook counting from the outermost circumference of the rotor are set to satisfy ($1.0<\beta\leqq 1.1\alpha$).

In the present invention, preferably, the rotor hook has a contact surface in which the rotor contacts with the blade and a non-contact surface positioned on the outer circumferential side of the rotor hook, the contact surface and the non-contact surface being interconnected by an inscribed circular surface or by a flat surface and inscribed circular surfaces on both sides of the flat surface. Further, an insert angle at which the blade is inserted is skewed relative to the axial direction of the rotor.

To achieve the above objects, the present invention also provides a low-pressure steam turbine comprising a rotor shaft, moving blades implanted to the rotor shaft, nozzle blades for guiding inflow of the steam toward the moving blades, and a casing for holding the nozzle blades, wherein the moving blades are arranged in one side alone, in bilaterally symmetrical relation, or in bilaterally asymmetrical relation with respect to the inflow of steam toward the moving blades which are disposed in four or more stages at least in one side. Further, the present invention provides a high- and low-pressure integral steam turbine comprising a rotor shaft integrally formed to be exposed to high-temperature steam ranging from high pressure to lower pressure, moving blades implanted to the rotor shaft, nozzle blades for guiding inflow of the steam toward the moving blades, and a casing for holding the nozzle blades. In any of those steam turbines, the rotor shaft is the above-described rotor, and the moving blade at least in the last stage is the above-described blade.

To achieve the above objects, the present invention further provides a steam turbine power plant including any of a set of a high-pressure steam turbine, an intermediate-pressure steam turbine and a low-pressure steam turbine, a set of a high- and intermediate-pressure integral steam turbine and a low-pressure steam turbine, and a high- and low-pressure integral steam turbine, wherein the low-pressure steam turbine and/or the high- and low-pressure integral steam turbine is the above-described one.

According to the present invention, in the turbine rotor in which the rotor material has lower tensile strength than the blade material and the difference in tensile strength between both the materials is large, a strength margin on the blade side is properly distributed to a strength margin on the rotor side with the aim of reducing shear stress in the rotor hook, increasing stiffness of the rotor hook, and reducing peak stress in the rotor neck, to thereby provide the steam turbine rotor and the turbine blade in which stress balance is made more appropriate depending on a material strength ratio of the blade material to the rotor material. Further, the present invention is able to provide the low-pressure steam turbine and the high-, intermediate- and low-pressure integral steam turbine which include those rotors and blades, as well as the steam turbine power plant with those turbines.

BRIEF DESCRIPTION OF THE DRAWINGS

FIGS. 1A-1C show the relationship between hooks and necks of a turbine blade and a turbine rotor according to the present invention, in which FIG. 1A is a cross-sectional view of principal parts, FIG. 1B is an enlarged view of an area b in FIG. 1A, and FIG. 1C is an enlarged view of an area c in FIG. 1A;

DESCRIPTION OF THE PREFERRED EMBODIMENTS

The best mode for carrying out the present invention will be described below in connection with preferred embodiments.

First Embodiment

Figure 1A:
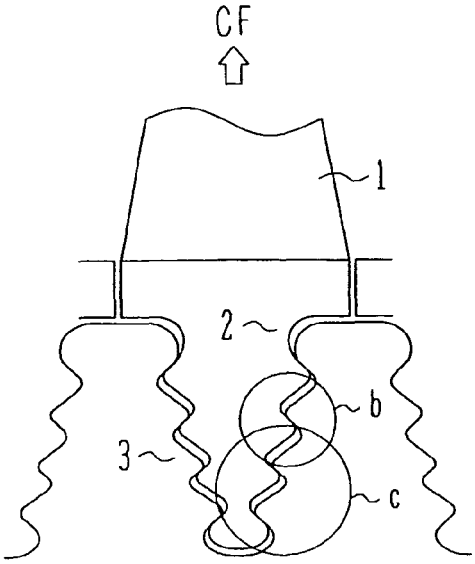
Figure 1B:
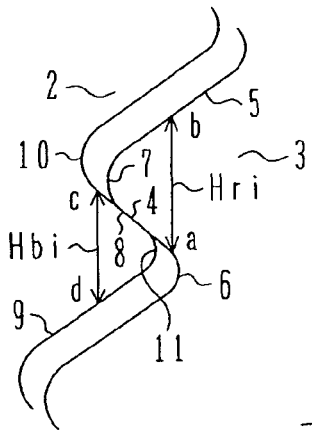
Figure 1C:
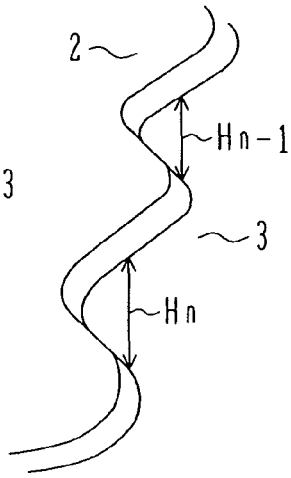

FIG. 1A is a partial cross-sectional view of a turbine rotor according to the present invention, FIG. 1B is an enlarged view of an area b in FIG. 1A, and FIG. 1C is an enlarged view of an area c in FIG. 1A. This first embodiment is related to a turbine rotor 3 in which the tensile strength of a blade material is 965-1325 MPa and the tensile strength of a rotor material is 825-945 MPa, namely the tensile strength of the blade material is 1.2-1.6 times that of the rotor material, and in which the turbine rotor has an attachment structure with respect to an inverted fir-tree blade root 2 extending from a turbine moving blade 1 in a direction toward the rotor center.

In the turbine rotor 3 having the attachment structure with respect to the turbine blade 1 having the inverted fir-tree blade root 2, four hooks are formed in each of the blade root and a rotor groove. The blade root is inserted in the axial direction of the turbine rotor such that the respective hooks of the blade and the rotor are attached to each other, thereby bearing a centrifugal force CF exerted on the blade. The blade hooks and the rotor hooks have a symmetrical structure with respect to a center line.

The hooks of the turbine blade 1 and the turbine rotor 3 have a structure that respective rotor and blade hook contact surfaces 4 and 8 contacting with each other and respective rotor and blade hook non-contact surfaces 5 and 9 positioned in the same hooks as the contact surfaces are interconnected by respective rotor- and blade-hook inscribed circular surfaces 7 and 11. In the related art, an i-th rotor hook counting from the outermost circumference of a rotor and an i-th blade hook counting from the outermost circumference of a blade are formed in congruency relation.

This embodiment is featured in forming the turbine rotor such that a rotor radial-direction hook length (Hri) of an i-th rotor hook counting from the outermost circumference of the rotor is larger than a blade radial-direction hook length (Hbi) of an i-th blade hook counting from the outermost circumference of the blade. Let here assume, as shown in FIG. 1, that in the i-th rotor hook counting from the outermost circumference of the rotor, an interface at which the hook contact surface 4 and an inscribed circular surface 6 forming the neck are joined with each other is a, and a cross point at which a line starting from the point a and extending parallel to a radial-direction line passing the center of the blade root intersects the rotor hook non-contact surface 5 corresponding to the above rotor hook contact surface 4 is b. On that assumption, the distance from the point a to b is defined as the rotor radial-direction hook length (Hri) of the rotor hook. On the side of the turbine blade 1, the hook length is also similarly defined. Let here assume that in the i-th blade hook counting from the outermost circumference of the blade, an interface at which the hook contact surface 8 and an inscribed circular surface 10 forming the neck are joined with each other is c, and a cross point at which a line starting from the point c and extending parallel to the radial-direction line passing the center of the blade root intersects the blade hook non-contact surface 9 corresponding to the above blade hook contact surface 8 is d. On that assumption, the distance from the point c to d is defined as the blade radial-direction hook length (Hbi) of the blade hook.

Thus, the turbine blade 1 and the turbine rotor 3 are formed such that their radial-direction hook lengths have the relationship of Hri>Hbi (i=1 to n−1). In other words, the respective radial-direction hook lengths of the turbine blade 1 and the turbine rotor 3 always satisfy the above relationship at each corresponding position. By relatively increasing the radial-direction hook length on the rotor side, it is possible to reduce shear stress in the hook and to reduce peak stress caused in a stress concentrated portion of the neck with an increase of the hook stiffness.

Further, the radial-direction hook length (Hri) of the rotor hook is set such that the innermost hook has a larger radial-direction hook length than the j-th (j=2 to n−1) intermediate hook counting from the outermost circumference. Stated another way, assuming that the rotor hook at the innermost circumference has a rotor radial-direction hook length (Hrn) and the j-th (j=2 to n−1) intermediate rotor hook counting from the outermost circumference of the rotor has a rotor radial-direction hook length (Hrj), the relationship of Hrn>Hrj (j=2 to n−1) is satisfied. With such design of the hook shape, shear stress in the rotor innermost circumference hook having a larger load share ratio can be reduced. In addition, preferably, the rotor radial-direction hook length (Hri) of the rotor hook is largest in the outermost circumference hook as compared with the other hooks.

Figure 2:
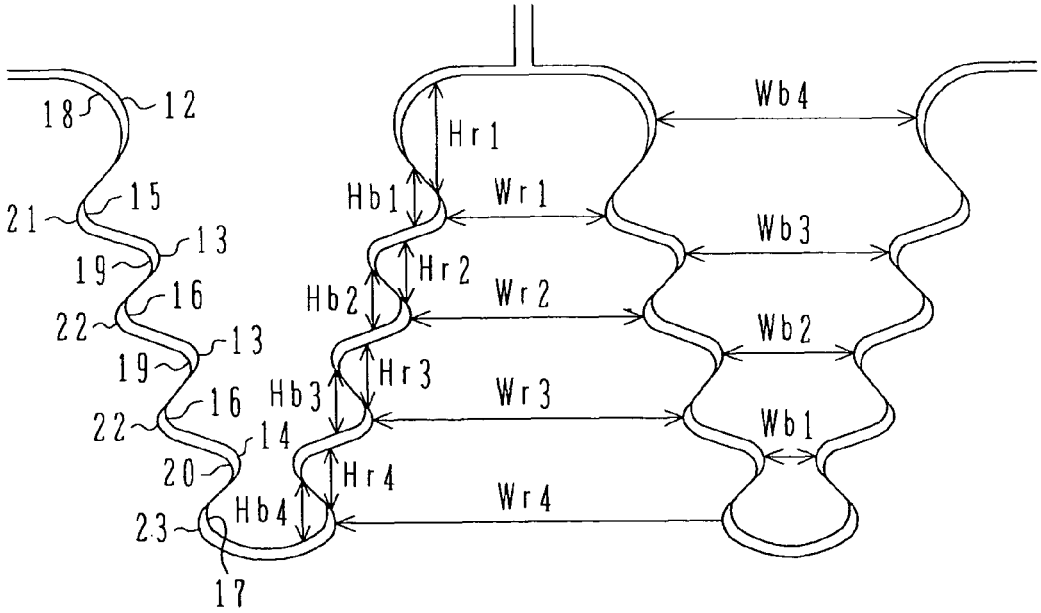
FIG. 2 is a cross-sectional view of principal parts, the view showing the relationship between neck widths of the turbine blade and the turbine rotor according to the present invention.

FIG. 2 is a cross-sectional view showing the relationship among circumferential-direction neck widths of the respective necks of the turbine blade and the turbine rotor according to the present invention. As shown in FIG. 2, a rotor circumferential-direction neck width (Wri) of an i-th rotor neck counting from the outermost circumference of the turbine rotor 3 and a blade circumferential-direction neck width (Wbi) of an i-th blade neck counting from the innermost circumference of the turbine blade 1 satisfy the relationship of Wri>Wbi (i=1 to n) for the same i number. In other words, at each of the corresponding positions counting by the same number respectively from the outermost circumference of the turbine rotor 3 and from the innermost circumference of the turbine blade 1, the circumferential-direction neck width of the turbine rotor neck is always larger than the circumferential-direction neck width of the turbine blade neck. For example, the rotor circumferential-direction neck width (Wr1) of the turbine rotor neck is larger than the blade circumferential-direction neck width (Wb1) of the turbine blade neck. A similar relationship is held for each of the subsequent i numbers. Finally, the circumferential-direction neck width (Wr4) of the turbine rotor neck is larger than the circumferential-direction neck width (Wb4) of the turbine blade neck.

Further, in this embodiment, the rotor circumferential-direction neck width (Wri) of the rotor neck is gradually increased from the outermost circumference of the turbine rotor 3, and the blade circumferential-direction neck width (Wb1) of the blade neck is gradually increased from the innermost circumference of the turbine blade 1.

The advantages of the present invention will be described below based on the calculation results using a finite element method (FEM). Parameters studied here are a tensile strength ratio α between the turbine blade material and the turbine rotor material (i.e., tensile strength of the turbine blade material/tensile strength of the turbine rotor material), a radial-direction hook length ratio β between the i-th blade hook and the i-th rotor hook counting from the outermost circumference (i.e., Hri/Hbi), and a ratio γ of the circumferential-direction neck width (Wbn) of the blade neck at the outermost circumference to the circumferential-direction neck width (Wrn) of the rotor neck at the innermost circumference (i.e., Wbn/Wrn).

The following description is first made of the results calculated for the cases where, assuming γ to be held fixed, the material strength ratio α between the blade material and the rotor material is set to be small (α=1.1) and large (α=1.5), the radial-direction hook length ratio β is set to β=1.0 representing the related art in which the respective hooks are in congruency relation, and β=1.2 and 1.4 are set in the structure of the present invention.

Figure 3:
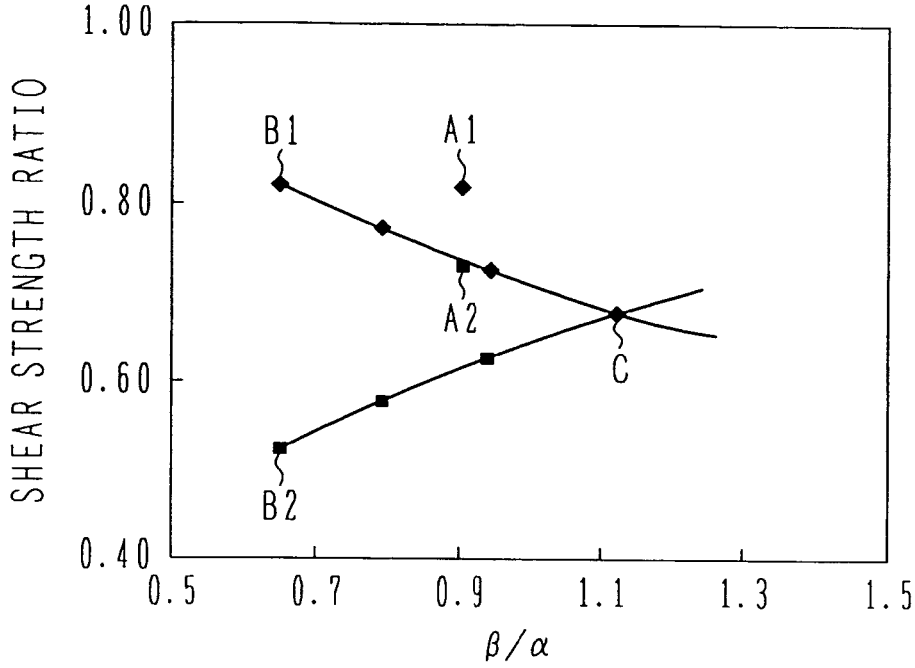
FIG. 3 is a graph showing the relationship between a shear strength ratio and ($\beta/\alpha$) in the turbine blade and the turbine rotor according to the present invention.

FIG. 3 is a graph showing the relationship between a shear strength ratio (shear strength/allowable stress), which is obtained by making stress dimensionless with respect to the allowable stress, and a ratio (β/α) of the radial-direction hook length ratio β (i.e., rotor radial-direction hook length/blade radial-direction hook length) to the ratio α (i.e., tensile strength of the turbine blade material/tensile strength of the turbine rotor material). As shown in FIG. 3, when the tensile strength of the turbine blade material is slightly higher than the tensile strength of the turbine rotor material (i.e., α=1.1) and β=1.0 is set as in the known structure in which the respective hooks of the turbine blade and the turbine rotor are formed in congruency relation, (β/α=0.9) is resulted and balance is taken between the shear strength ratio of the turbine blade (indicated by a point A2 in FIG. 3) and the shear strength ratio of the turbine rotor (indicated by a point A1 in FIG. 3).

On the other hand, when the tensile strength ratio between the turbine blade material and the turbine rotor material is large (α=1.5) and β=1.0 is set as in the known structure in which the respective hooks of the turbine blade and the turbine rotor are formed in congruency relation, (β/α=0.65) is resulted and the shear strength of the turbine rotor (indicated by a point B1 in FIG. 3) is much higher than the shear strength ratio of the turbine blade (indicated by a point B2 in FIG. 3). Note that each of A1, A2, B1 and B2 indicates a value of the shear strength ratio in the known structure.

In contrast, in the case of α=1.5, when β=1.2 (β/α=0.80) and β=1.4 (β/α=0.95) are set in the present invention in which the respective radial-direction hook lengths of the turbine blade and the turbine rotor satisfy the relationship of (Hri>Hbi) (i=1 to n−1), the strength margin of the turbine blade can be distributed to increase the strength of the turbine rotor side (i.e., to decrease the shear strength ratio), whereby stress balance can be taken between the turbine blade and the turbine rotor. A line extending from B1 indicates the shear strength ratio of the turbine rotor, and a line extending from B2 indicates the shear strength ratio of the turbine blade.

The balance in the shear strength ratio between the turbine blade and the turbine rotor is reversed in magnitude when (β/α) exceeds a point C of 1.13. Thus, as (β/α) is made closer to 1.13, the stress balance between the turbine rotor and the turbine blade becomes more appropriate.

Figure 4:
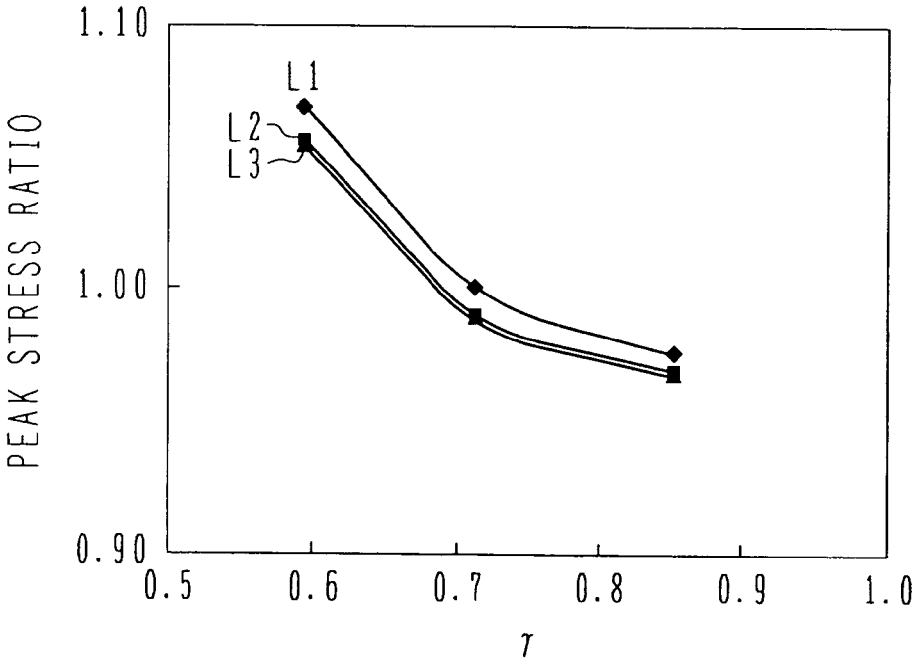
FIG. 4 is a graph showing the relationship between a peak stress ratio and $\gamma$ in the turbine blade and the turbine rotor according to the present invention.

FIG. 4 is a graph showing the relationship between a peak stress ratio on the basis of the peak stress at β=1.0, which is represented by the vertical axis, and the circumferential-direction neck width ratio γ (i.e., Wbn/Wrn), which is represented by the horizontal axis. In FIG. 4, L1 indicates a peak stress ratio curve in the case of β=1.0, L2 indicates a peak stress ratio curve in the case of β=1.2, and L3 indicates a peak stress ratio curve in the case of β=1.4. It is confirmed by FEM that, at any peak stress, the stress is reduced as β increases. A proper region of the circumferential-direction neck width ratio γ will be described below.

Figure 5:
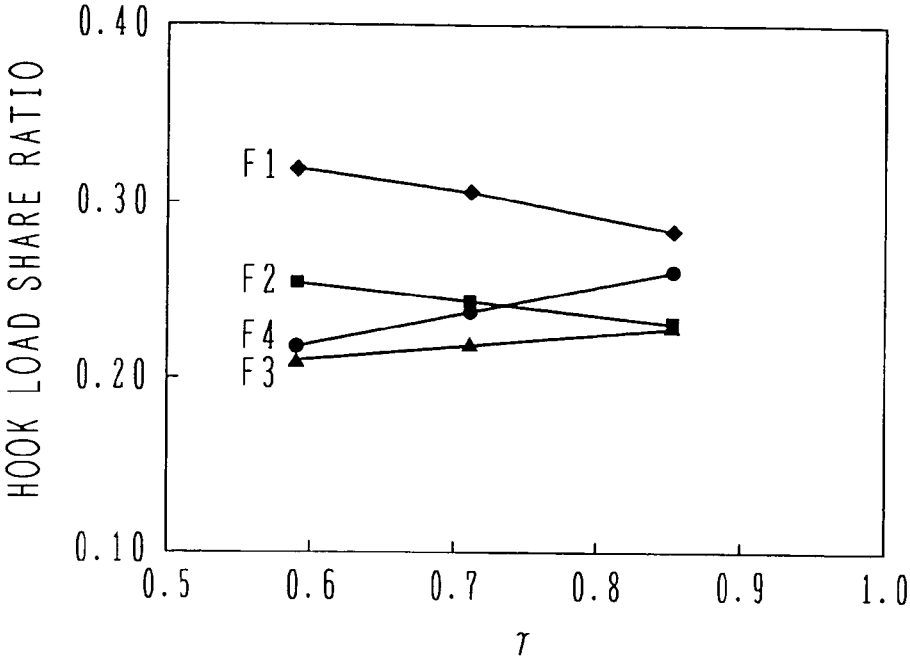
FIG. 5 is a graph showing the relationship between a hook load shear ratio and $\gamma$ in the turbine blade and the turbine rotor according to the present invention.

FIG. 5 is a graph showing the relationship between the circumferential-direction neck width ratio γ and a hook load share ratio analyzed by FEM. In FIG. 5, F1 indicates a load share ratio curve of the outermost circumference hook, F2 and F3 indicate load share ratio curves of the intermediate hooks, and F4 indicates a load share ratio curve of the innermost circumference hook. The hook load share ratio has such a tendency that, as the circumferential-direction neck width ratio γ increases, the load share ratio of the rotor innermost-circumference hook indicated by F4 is increased and the hook load share ratios of the rotor intermediate hooks indicated by F2 and F3 are decreased. Also, as shown in FIG. 4, as the circumferential-direction neck width ratio γ increases, the inverted fir-tree blade root is enlarged and each hook is formed in larger size. Accordingly, the peak stress is reduced and workability is increased.

However, if the circumferential-direction neck width ratio γ is too increased, tensile stress in the rotor neck may become excessively large. For that reason, the circumferential-direction neck width ratio γ is preferably set to satisfy $\gamma \leqq 1.0$.

A region taking into account balance between the hook load share ratio and the tensile stress of the rotor neck corresponds to a region where the load share ratio of the rotor innermost-circumference hook indicated by F4 is larger than the hook load share ratios of the rotor intermediate hooks indicated by F2 and F3. Setting the rotor radial-direction hook length (Hrn) of the rotor hook at the innermost circumference to be larger than the rotor radial-direction hook length (Hrj) of the j-th rotor intermediate hook counting from the outermost circumference of the rotor is equivalent to increase the radial-direction length of the hook having a larger load share ratio and is effective in making stress balance between the hooks more appropriate.

Figure 6:
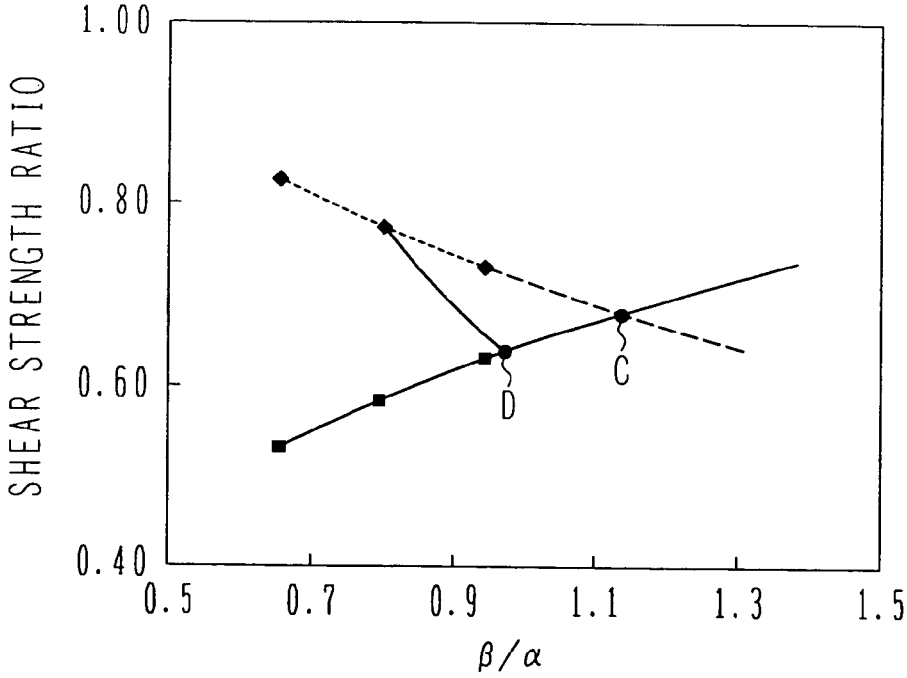
FIG. 6 is a graph showing the relationship between the shear strength ratio and ($\beta/\alpha$) in the turbine blade and the turbine rotor according to the present invention.

FIG. 6 is a graph showing the relationship between the shear strength ratio and (β/α), which is resulted when a ratio η of the rotor radial-direction hook length (Hrn) of the turbine rotor hook at the innermost circumference of the rotor to the rotor radial-direction hook length (Hrj) of the j-th rotor intermediate hook counting from the outermost circumference of the rotor (i.e., Hrn/Hrj) is set to $\eta=1.2$. By employing the above-described structure on condition of the radial-direction hook length ratio $\beta=1.2$, an effect is obtained in further reducing the shear strength ratio by about 5% (as indicated by a point D in FIG. 6) from the point C where the effect of reducing the shear strength ratio is obtained based on balance between the turbine blade and the turbine rotor with selection of the respective radial-direction hook lengths.

In this embodiment, an angle at which the turbine blade root is inserted to the turbine rotor is perpendicular to the axial direction of the turbine rotor. However, when the turbine blade and the turbine rotor have a structure that the turbine blade root is inserted to the turbine rotor at an angle skewed relative to the axial direction of the turbine rotor, the axial distance can be increased by (1/cos θ) of the insert angle θ against the axial direction. Accordingly, by employing such a structure, stress caused in the hook shear surface can be more effectively reduced.

With this embodiment, by setting the radial-direction hook length (Hri) of the i-th rotor hook counting from the outermost circumference of the rotor and the radial-direction hook length (Hbi) of the i-th blade hook counting from the outermost circumference of the blade to satisfy Hri>Hbi, the shear stress in the rotor hook can be reduced. In the turbine rotor having a difference in tensile strength between the blade material and the rotor material, particularly, the strength margin on the blade side can be properly distributed to the strength margin on the rotor side. Still another advantage is obtained in that the peak stress in the neck can be reduced with an increase in stiffness of the rotor hook.

Further, by forming the radial-direction hook length (Hrn) of the rotor hook at the innermost circumference of the rotor to be longer than the radial-direction hook length (Hrj) of the j-th intermediate rotor hook counting from the outermost circumference of the rotor, the shear strength of rotor outermost-circumference hook having a higher load share ratio can be increased and stress balance between the hooks can be made more appropriate.

Thus, according to the first embodiment, when the material strength of the rotor material is lower than that of the blade material and the difference in material strength between the rotor and the blade is large, it is possible to provide the turbine rotor and the turbine blade in which stress balance is made more appropriate depending on the material strength ratio between the blade material and the rotor material.

Second Embodiment

Figure 7:
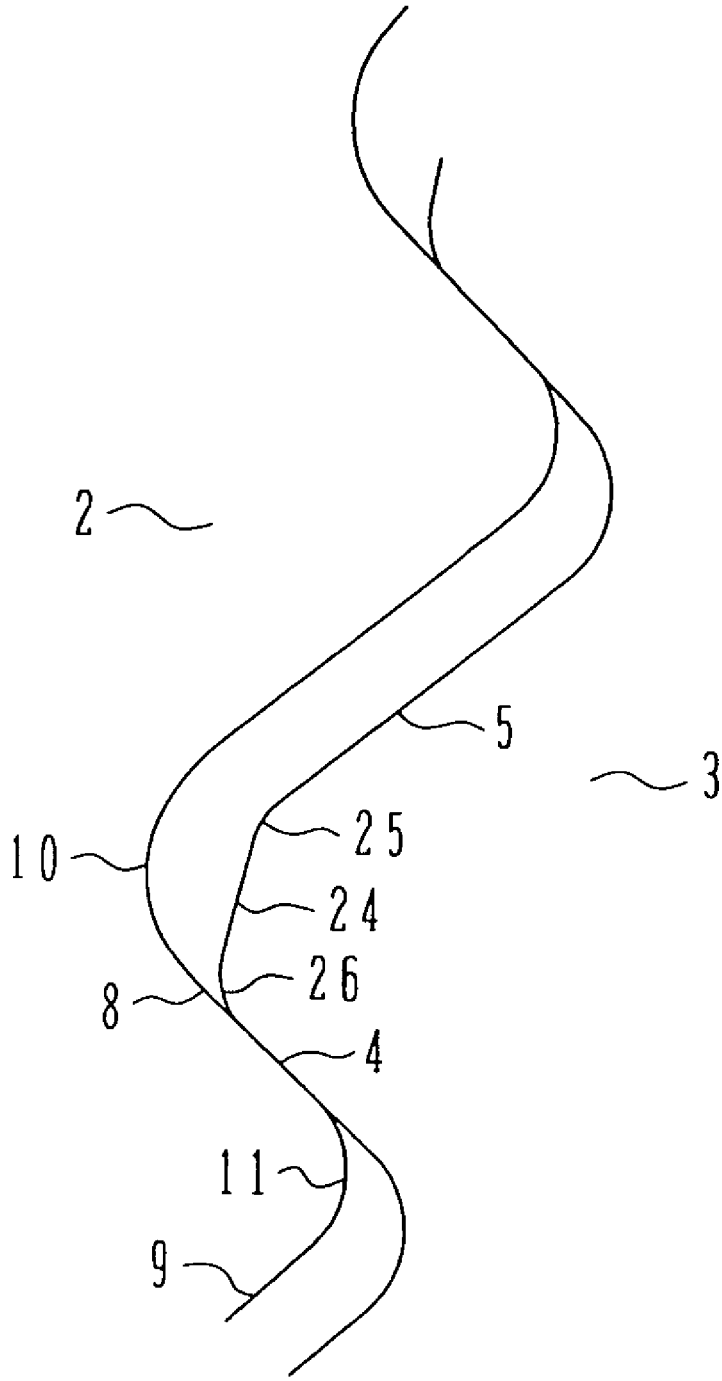
FIG. 7 is an enlarged cross-sectional view of principal parts, the view showing the relationship between the hooks and the necks of the turbine blade and the turbine rotor according to the present invention.

FIG. 7 is an enlarged cross-sectional view of principal parts of the turbine rotor according to the present invention. The hook of the turbine rotor 3 is shaped such that the hook contact surface 4 and the hook non-contact surface 5, shown in FIG. 1, are interconnected by a flat surface 24 and inscribed circular surfaces 25 and 26 formed on both sides of the flat surface 24. With such a structure, the circumferential-direction size of the turbine rotor hook can be reduced in comparison with the hook of the first embodiment in which the hook contact surface 4 and the hook non-contact surface 5 are interconnected by one inscribed circular surface 7. Therefore, the tensile stress in the blade neck can be reduced and workability can be increased. Though not shown in FIG. 7, the turbine blade 1 is also preferably formed such that surfaces corresponding to the hook contact surface 4 and the hook non-contact surface 5 are interconnected by surfaces similar to the flat surface 24 and the inscribed circular surfaces 25 and 26 formed on both sides of the flat surface 24.

Also, the inscribed circular surfaces forming the i-th hooks and the i-th necks of the turbine blade and the turbine rotor counting from the outermost circumference are not necessarily required to be the same ones. The inscribed circular surface may be formed of two different inscribed circular surfaces or formed of a flat surface and two different inscribed circular surfaces formed on both sides of the flat surface. Further, the outermost circumference hook, the intermediate hook, and the innermost circumference hook may be each formed by any of the above-described combinations.

Thus, as with the first embodiment, this second embodiment can also provide the turbine rotor in which when the difference in material strength between the rotor material and the blade material is large, stress balance is made more appropriate depending on the material strength ratio between the blade material and the rotor material.

Third Embodiment

Figure 8A:
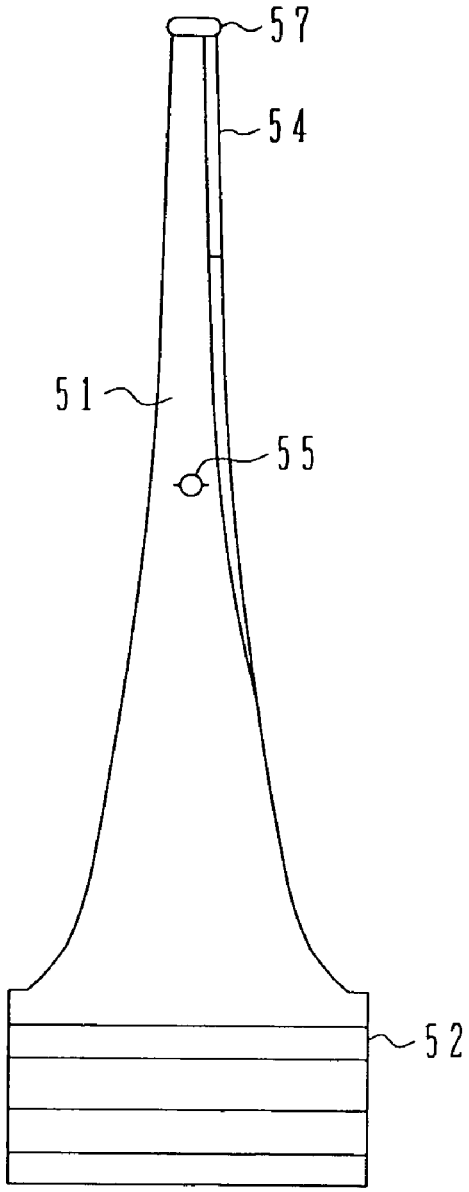
FIGS. 8A and 8B are a front view and a side view of the turbine blade according to the present invention.
Figure 8B:
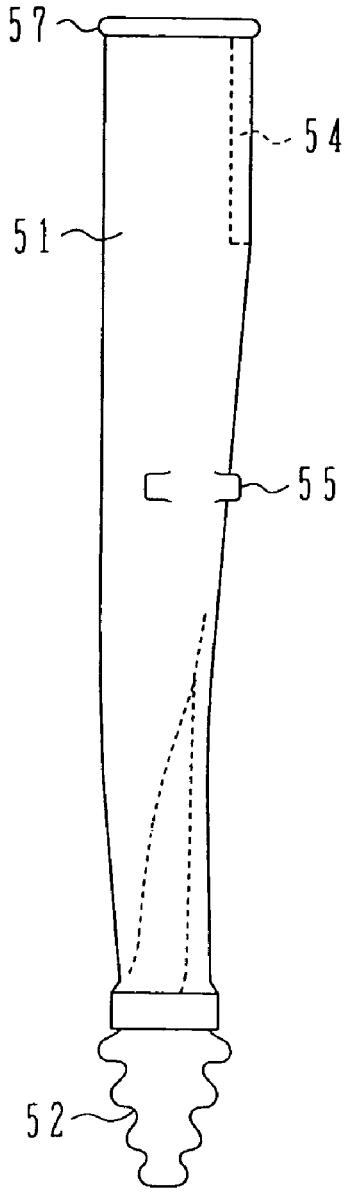

FIGS. 8A and 8B show a long blade for 3000 rpm, which has an airfoil height of 48" (inches) and is used as the last stage blade of a low-pressure steam turbine according to the present invention. Specifically, FIG. 8A is a front view and FIG. 8B is a side view. As shown in FIG. 8, a blade root 52 is in the form of an inverted fir tree and has four stages of straight hooks on each of opposite sides of the blade root 52. Such blade hooks and blade necks have the same structure as that in the first or second embodiment. The blade root having those blade hooks and necks are attached respectively to corresponding rotor hooks and necks. An airfoil 51 has a thickness that is at maximum in the root and is gradually reduced toward its tip.

The last-stage blade in this third embodiment is made of steel which contains 0.15-0.40% by weight of C, 0.5% or less of Si, 1.5% or less of Mn, 2.0-3.5% of Ni, 8-13% of Cr, 1.5-4.0% of Mo, 0.05-0.35% of V, 0.04-0.15% of N, and, as required, 0.02-0.3% of at least one of Nb and Ta, and which has a fully tempered martensite structure.

To obtain the long blade of the last stage, after electroslag remelting, the steel is subjected to smelting, forging, and thermal refining, i.e., quenching (preferably oil quenching) through steps of heating and holding to 1000-1100° C. (preferably 1000-1055° C.) and subsequent quick cooling to room temperature, primary tempering at 540-620° C., and secondary tempering through steps of heating and holding to 560-590° C. and subsequent cooling to room temperature.

The martensite steel of the last-stage blade according to this embodiment has tensile strength of 965-1450 MPa at 20° C. and a V-notch impact value of 6 kg-m/cm$^2$ or more at 20° C. based on the C content, the presence or absence of Nb and Ta, and the contents of Nb and/or Ta if present.

The long blade includes the airfoil 51 against which steam impinges, the blade root 52 implanted to a rotor shaft, a tie boss 55, and a continuous cover 57. To prevent erosion caused by water droplets in the steam, an erosion shield 54 formed of a cobalt-base alloy containing 1.0% by weight of C, 28.0% of Cr, and 4.0% of W is joined to the leading side of the airfoil 51 by electron beam welding.

In the last-stage blade according to this embodiment, adjacent airfoils 51 are arranged to be overlapped with each other, and the continuous cover 57 is provided so as to block a flow of steam. Further, the last-stage blade is produced by a forming process integrally with a blade body using the same material. The tip of the airfoil 51 has a twisted structure such that the tip is twisted from the root 52 in crossing relation to the axial direction.

The height of the last-stage blade according to this embodiment can be set to be 40" or more, preferably 42"-46", for 3600 rpm, and 48" or more, preferably 50"-55", for 3000 rpm.

Figure 9:
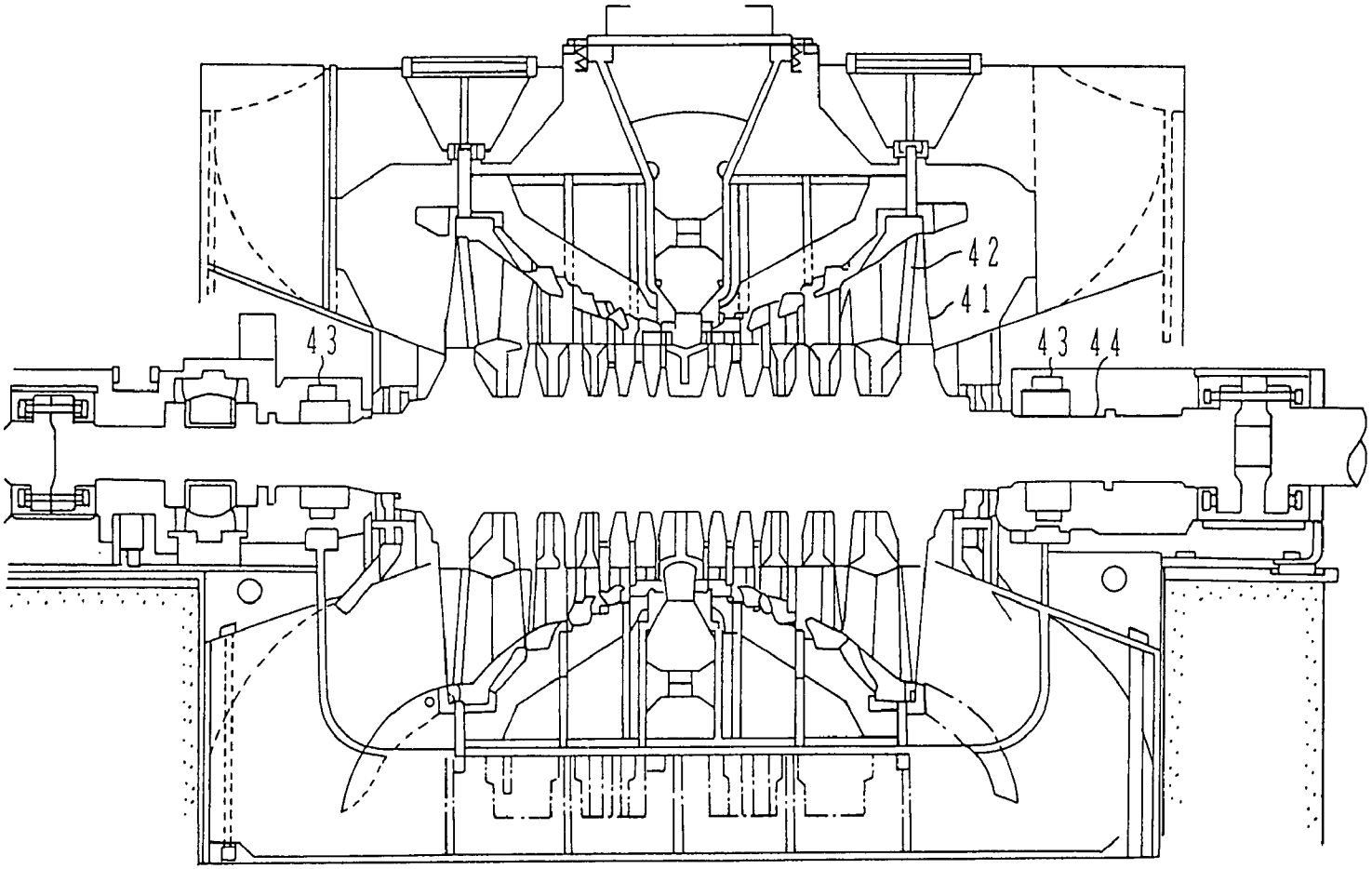
FIG. 9 is a cross-sectional view of a low-pressure steam turbine according to the present invention.

FIG. 9 is a cross-sectional view of a low-pressure steam turbine according to this embodiment. The low-pressure steam turbine is of the double flow type that steam is introduced to a central portion of the turbine. Six stages of moving blades 41 are arranged in each of the left and right sides in substantially bilaterally symmetrical arrangement. A stator nozzle blade 42 is arranged corresponding to each moving blade 41. A portion of a rotor shaft 44 to which is implanted the blade 41 is in the form of a disk.

In this embodiment, the rotor shaft 44 having the portion to which is implanted the turbine blade root according to the first or second embodiment is made of low-alloy steel which contains 0.2-0.3% by weight of C, 0.15% or less of Si, 0.25% or less of Mn, 3.25-4.25% of Ni, 1.6-2.5% of Cr, 0.25-0.6% of Mo, and 0.05-0.25% of V, and which has a fully tempered bainite structure. Also, it is desired that the low-alloy steel be produced through a super-cleaning process by using raw materials containing impurities, such as P, S, As, Sb and Sn, as low as possible and reducing the total amount of the impurities to be 0.025% or less, preferably 0.015% or less.

The rotor shaft according to this embodiment is produced through a series of steps of smelting of an ingot by any of vacuum melting, vacuum carbon deoxidation melting, and electroslag remelting, casting to obtain cast steel, hot-forging at 850-1150° C., quenching by heating of 840° C.×3 hours and subsequent cooling at a rate of 100° C./h, and tempering by heating and holding to 575° C. By reducing the above-mentioned impurities as low as possible, the rotor shaft according to this embodiment has high strength and high toughness, i.e., tensile strength of 825-980 MPa, a V-notch impact value of 10 kg-m or more, and FATT (Fracture Appearance Transition Temperature) of −20° C. or below. That rotor shaft enables the last-stage blade according to this embodiment to be implanted with the airfoil height of 48 inches or more, including even 55 inches. When the rotor shaft has the inverted fir-tree turbine rotor like this embodiment, a center bore is preferably not formed in the rotor shaft.

12%-Cr steel containing 1% or less of Mo is used as each of the moving blades and the nozzle blades in other stages than the last stage. Cast steel containing 0.25% of C is used as each of inner and outer casings.

According to this embodiment, the airfoil height of the last-stage blade in the low-pressure steam turbine is 48 inches. A steam turbine system employing that low-pressure steam turbine can be constituted as not only the 4-flow exhaust cross-compound type including one high-pressure steam turbine (HP), one intermediate-pressure steam turbine (IP), and two low-pressure steam turbines (LP), but also as any of combinations of HP-LP, IP-LP, and HP-IP-LP. In any case, the number of revolutions is 3000 rpm (revolutions per minute).

A steam turbine power plant according to this embodiment comprises primarily a boiler, the HP, the IP, the LP, a condenser, a condensing pump, a low-pressure feedwater heater system, a deaerator, a booster pump, a feedwater pump, and a high-pressure feedwater heater system.

Thus, in the low-pressure steam turbine according to this embodiment, the last-stage blade material has larger tensile strength than the rotor material, specifically the tensile strength of the blade material is 1.2-1.6 times that of the rotor material, and the turbine rotor 44 has an attachment structure for the inverted fir-tree blade root extending from the turbine blade 41 toward the rotor center. As in the first and second embodiments, when the difference in material strength between the blade and the rotor is large, it is possible to provide the turbine rotor and blade structure in which stress balance is made more appropriate depending on the material strength ratio between the blade material and the rotor material, by forming the turbine rotor and blade such that the radial-direction hook length (Hri) of the i-th rotor hook counting from the outermost circumference of the rotor and the radial-direction hook length (Hbi) of the i-th blade hook counting from the outermost circumference of the blade satisfy the relationship of Hri>Hbi (i=1 to n−1) and that the circumferential-direction neck width (Wri) of the i-th rotor neck counting from the outermost circumference of the rotor and the circumferential-direction neck width (Wbi) of the i-th blade neck counting from the innermost circumference of the blade satisfy the relationship of Wri>Wbi (i=1 to n).

Fourth Embodiment

Figure 10:
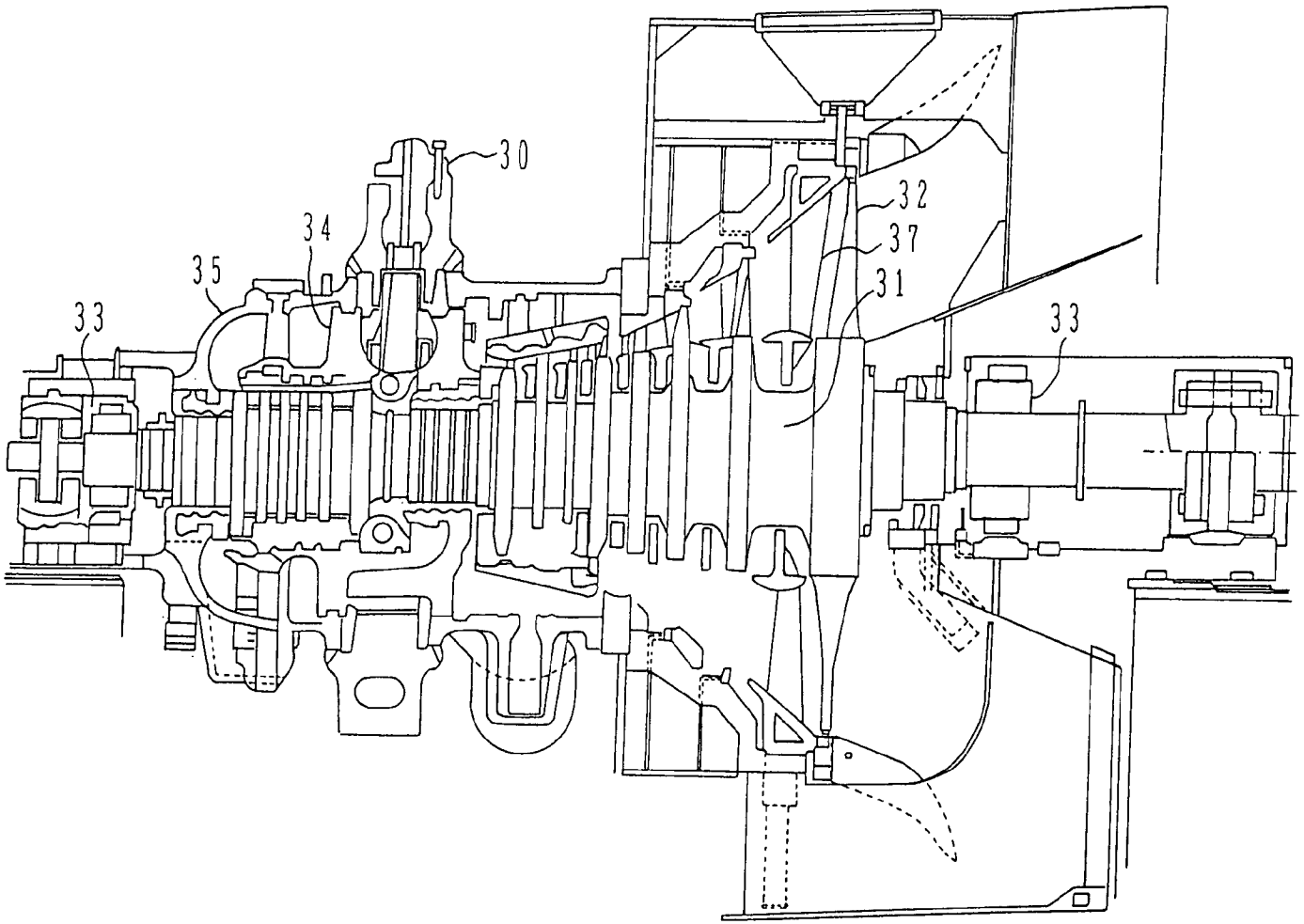
FIG. 10 is a partial cross-sectional view of a high-, intermediate- and low-pressure integral steam turbine according to the present invention.

FIG. 10 is a partial cross-sectional view of a high-, intermediate- and low-pressure integral steam turbine according to the present invention. In the high-, intermediate- and low-pressure integral steam turbine of this embodiment, a portion of a rotor shaft 31, which corresponds to the last-stage blade, and the last-stage blade are formed in the same shapes as those in the first and second embodiments, respectively. Further, the rotor shaft 31 is made of steel having the alloy composition described below, and the last-stage blade is made of the 12%-Cr steel described in the third embodiment.

In the high-, intermediate- and low-pressure integral steam turbine of this embodiment, blades are implanted to the rotor shaft 31 in six stages on the high pressure side and eight stages on the intermediate/low pressure side. High-temperature and high-pressure steam is introduced through a high-pressure side inlet 30 to flow in one direction and is exhausted through a last-stage blade 32 after passing through the intermediate/low pressure side. The high-, intermediate- and low-pressure integral rotor shaft 31 according to this embodiment is made of forged steel obtained from Ni—Cr—Mo—V low alloy steel (described below). A portion of the rotor shaft 31 to which is implanted the blade is in the form of a disk. The integral steam turbine further includes an inner casing 34, an outer casing 35, and a bearing 33.

The rotor shaft 31 according to this embodiment is made of Ni—Cr—Mo—V low alloy steel containing 0.15-0.4% by weight of C, 0.1% or less of Si, 0.05-0.3% of Mn, 1.5-2.5% of Ni, 0.8-2.5% of Cr, 0.08-2.5% of Mo, and 0.1-0.35% of V. The rotor shaft 31 according to this embodiment is produced through the steps of heating and holding forged steel having the above alloy composition to 950° C., performing water-spray quenching while rotating the shaft at a rate of 100° C./h in a central portion, and tempering the shaft by heating and holding it to 665° C. Heat treatment is preferably performed such that the high-temperature strength on the high-pressure side is higher than that on the low-pressure side, or the toughness on the low-pressure side is higher than that on the high-pressure side.

According to this embodiment, it is possible to reduce the shear stress in the rotor hook and to appropriately distribute the strength margin on the blade side to the strength margin on the rotor side by setting the tensile strength of the last-stage blade material at room temperature to be higher than that of the rotor material, setting the radial-direction hook length (Hri) of the i-th rotor hook counting from the outermost circumference of the rotor and the radial-direction hook length (Hbi) of the i-th blade hook counting from the outermost circumference of the blade to satisfy the relationship of Hri>Hbi (i=1 to n−1), and setting the circumferential-direction neck width (Wri) of the i-th rotor neck counting from the outermost circumference of the rotor and the circumferential-direction neck width (Wbi) of the i-th blade neck counting from the innermost circumference of the blade to satisfy the relationship of Wri>Wbi (i=1 to n). Further, the peak stress in the neck can be reduced with an increase in stiffness of the rotor hook.

What is claimed is:

1. A steam turbine rotor having rotor hooks and rotor necks which have an attachment structure with respect to an inverted fir-tree blade root having blade hooks and blade necks, wherein a rotor material has lower tensile strength than a blade material, and a rotor radial-direction hook length (Hri) of said rotor hook from an interface between a rotor hook contact surface contacting with said blade hook and an inscribed circular surface of said rotor neck is larger than a blade radial-direction hook length (Hbi) of said blade hook from an interface between a blade hook contact surface contacting with said rotor hook contact surface and an inscribed circular surface of said blade neck, and a rotor circumferential-direction neck width (Wri) of said rotor neck at a predetermined position counting from the outermost circumference of the rotor is larger than a blade circumferential-direction neck width (Wbi) of said blade neck at a corresponding position of the same number as said rotor neck counting from the innermost circumference of the blade.

2. The steam turbine rotor according to claim 1, wherein a rotor radial-direction hook length (Hrn) of said rotor hook at the innermost circumference and a rotor radial-direction hook length (Hrj) of an intermediate one of said rotor hooks satisfy a relationship of Hrn>Hrj (j=2 to n−1).

3. The steam turbine rotor according to claim 1, wherein a tensile strength ratio a between a blade material and a rotor material (blade material tensile strength/rotor material tensile strength) and a ratio β of (Hri/Hbi) are set to satisfy:

$$1.0<\beta\leqq 1.1\alpha.$$

4. The steam turbine rotor according to claim 1, wherein said rotor hook has said contact surface contacting with said blade hook and a non-contact surface not contacting with said blade hook, said contact surface and said non-contact surface being interconnected by an inscribed circular surface.

5. The steam turbine rotor according to claim 1, wherein said rotor hook has said contact surface contacting with said blade hook and a non-contact surface not contacting with said blade hook, said contact surface and said non-contact surface being interconnected by a flat surface and inscribed circular surfaces on both sides of said flat surface.

6. The steam turbine rotor according to claim 1, wherein an insert angle at which said blade is inserted is skewed relative to the axial direction of said rotor.

7. A steam turbine rotor including rotor hooks and rotor necks which have an attachment structure with respect to an inverted fir-tree blade root having blade hooks and blade necks, wherein a rotor material has lower tensile strength than a blade material, and a rotor radial-direction hook length (Hri) of said rotor hook from an interface between a rotor hook contact surface contacting with said blade hook and an inscribed circular surface of said rotor neck is larger than a blade radial-direction hook length (Hbi) of said blade hook from an interface between a blade hook contact surface contacting with said rotor hook contact surface and an inscribed circular surface of said blade neck.

8. A steam turbine rotor including rotor hooks and rotor necks which have an attachment structure with respect to an inverted fir-tree blade root having blade hooks and blade necks, wherein a rotor material has lower tensile strength than a blade material, and a rotor circumferential-direction neck width (Wri) of said rotor neck at a predetermined position counting from the outermost circumference of the rotor is larger than a blade circumferential-direction neck width (Wbi) of said blade neck at a corresponding position of the same number as said rotor neck counting from the innermost circumference of the blade.

9. An inverted fir-tree turbine blade having blade hooks and blade necks which have an attachment structure with respect to a turbine rotor having rotor hooks and rotor necks, wherein a blade material has higher tensile strength than a rotor material, and a blade radial-direction hook length (Hbi) of said blade hook from an interface between a blade hook contact surface contacting with said rotor hook and an inscribed circular surface of said blade neck is smaller than a rotor radial-direction hook length (Hri) of said rotor hook from an interface between a rotor hook contact surface in a position contacting with said blade hook contact surface and an inscribed circular surface of said rotor neck.

10. An inverted fir-tree turbine blade having blade hooks and blade necks which have an attachment structure with respect to a turbine rotor having rotor hooks and rotor necks, wherein a blade material has higher tensile strength than a rotor material, and a blade circumferential-direction neck width (Wbi) of said blade neck at a predetermined position counting from the innermost circumference of the blade is smaller than a rotor circumferential-direction neck width (Wri) of said rotor neck at a corresponding position of the same number as said blade neck counting from the outermost circumference of the blade.

* * * * *